United States Patent [19]

Apprille, Jr. et al.

[11] Patent Number: 4,742,909

[45] Date of Patent: May 10, 1988

[54] SHAVING CARTRIDGE RETAINING CASINGS AND STORAGE TRAY THEREFOR

[76] Inventors: Domenic V. Apprille, Jr., 70 Decatur St., Arlington, Mass. 02174; Michael J. Gray, 20 Windward Way, Duxbury, Mass. 02332; Chester F. Jacobson, 10 Pinecone La., Southboro, Mass. 01772; Ronald P. Weston, 83 Blueberry La., Reading, Mass. 01867

[21] Appl. No.: 48,825

[22] Filed: May 12, 1987

[51] Int. Cl.[4] ..... B65D 83/10

[52] U.S. Cl. ..... 206/356; 206/354; 30/40.2; 30/50

[58] Field of Search ..... 206/352, 354, 355, 356; 30/40, 40.2, 50; 221/307, 308, 309, 310

[56] References Cited

U.S. PATENT DOCUMENTS

| | | | |
|---|---|---|---|
| 3,771,223 | 11/1973 | Dawidowicz | 30/40 |
| 3,783,493 | 1/1974 | Dawidowicz | 30/40 |
| 3,785,051 | 1/1974 | Dawidowicz | 30/40 |
| 3,854,201 | 12/1974 | Dawidowicz et al. | 206/356 |
| 3,880,284 | 4/1975 | Pomfret | 206/354 |
| 4,034,892 | 7/1977 | Braginetz | 206/356 |
| 4,043,035 | 8/1977 | Pentney | 30/40 |
| 4,047,295 | 9/1977 | Francis | 30/40 |
| 4,128,172 | 12/1978 | Joyce | 206/352 |
| 4,173,285 | 11/1979 | Kiraly et al. | 206/356 |
| 4,587,730 | 5/1986 | Iten | 30/90 |
| 4,601,392 | 7/1986 | Althaus | 206/355 |

FOREIGN PATENT DOCUMENTS 2405175 8/1974 Fed. Rep. of Germany ..... 306/355

*Primary Examiner*—David T. Fidei

*Attorney, Agent, or Firm*—Scott R. Foster

[57] ABSTRACT

The present disclosure is directed to a plurality of individual protective safety razor head unit open top casings and a tray for storing the plurality of casings in side-by-side relationships. Each of the casings are adapted to retain a single safety razor cartridge unit therein, each of which have at least one blade and a head cartridge member to which the blade is permanently secured and which also provides a guard surface. The head unit is detachably engageable with a safety razor handle. Each casing defines a single chamber in which a single shaving head unit is retained. The structure in each casing retains the head unit therein against accidental removal in such a manner that the cutting edge of the blade is protected against damage and wherein the head unit is engageable by the handle while the head unit is still within the casing. Each head unit when engaged with the handle is withdrawable from its casing by means of rocking the handle. The tray comprises slide means securing structure to secure each individual casing in the tray in a side-by-side relationship, and the tray and slide means are so configured as to permit each of the casings to be slid endwise out of the tray by the handle engaged with the razor head such that with the handle engaged with the head an operator may remove the blade unit from the casing or may alternatively slidably remove the blade unit and casing from the tray.

5 Claims, 3 Drawing Sheets

SHAVING CARTRIDGE RETAINING CASINGS AND STORAGE TRAY THEREFOR

FIELD OF THE INVENTION

The invention relates to wet shaving implements and is directed more particularly to shaving blade assemblies or cartridges which are dispensed in open top casings which are stored in trays in side-by-side relationship and which may be removed from each casing upwardly through its open top or the casing and cartridge together may be removed from the tray edgewise thereof by a handle being connected to the cartridge.

BACKGROUND ART

In the wet shaving art replaceable razor blade assembly cartridges have been known for several years which could be replaced on a shaving handle assembly such as the type shown in the following U.S. Letters Patent:

| | | |
|---|---|---|
| C. F. Jacobson | Dec. 18, 1984 | 4,488,357 |
| C. F. Jacobson | Jan. 8, 1985 | 4,492,024 |
| C. F. Jacobson | Jan. 8, 1985 | 4,492,025 |
| C. F. Jacobson | Nov. 12, 1985 | 4,551,916 |
| C. F. Jacobson | Feb. 12, 1985 | 4,498,235 |

Several type of storage trays and magazines have been advanced for containing and transporting shaving cartridges such as the types shown in the following U.S. patents:

| | | |
|---|---|---|
| J. Dawidowicz et al | Jan. 15, 1974 | 3,785,051 |
| E. A. Pomfret | Apr. 29, 1975 | 3,880,284 |
| H. Pentney | Aug. 23, 1977 | 4,043,035 |
| J. F. Francis | Sep. 13, 1977 | 4,047,295 |
| M. F. Joyce | Dec. 5, 1978 | 4,128,172 |

The cartridge tray type where the cartridge may be engaged by a razor handle and removed from the tray with a rocking motion of the shaving handle is the type shown in the following U.S. Letters Patent:

| | | |
|---|---|---|
| J. Dawidowicz et al | Nov. 13, 1973 | 3,771,223 |
| J. Dawidowicz et al | Jan. 8, 1974 | 3,783,493 |

Casings or cartridge covers have been shown in the following U.S. Letters Patent:

| | | |
|---|---|---|
| C. A. Iten | May 13, 1986 | 4,587,730 |
| W. Althaus | July 22, 1986 | 4,601,392 |

SUMMARY OF THE INVENTION

As described in the above identified prior art patents razor shaving assembly cartridges have been known which have trays and magazines therefor as well as overcovers or casings for covering cartridges mounted on shaving handles but there has not been known prior to the present invention a transport tray and casings for carrying a plurality of razor blade assemblies each in an open top casing from which the blade assembly may be removed from the open top of the casing without removing the casing from the tray or a casing and cartridge may be removed edgewise or transversely of the major axis of a tray with the cartridge within the casing for subsequent removal from the casing by engaging the handle in the casing with one hand, grasping the inverted casing with the other hand and rocking the cartridge to remove it from the casing.

An object of the present invention is to permit the cartridges to be removed individually from each casing while each casing is maintained engaged with the tray or the casing containing a cartridge may be removed from the tray and the handle employed to remove the cartridge from the casing for shaving at a later time and replaced into the casing for either transport during a trip or the casing and its cartridge returned to the tray.

DESCRIPTION OF THE FIGURES OF DRAWINGS

PREFERRED EMBODIMENT OF THE INVENTION

Figure 1:
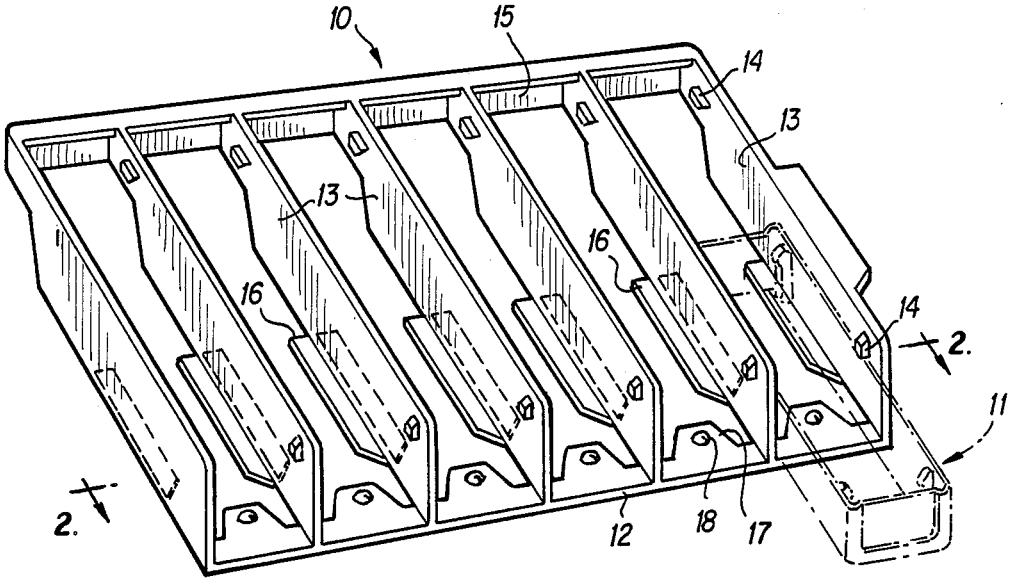
FIG. 1 is a perspective view of a cartridge and casing magazine tray for receiving a plurality of razor cartridges within casings in side-by-side relation for selectively removing either a cartridge upwardly from each casing or removing the cartridge and its carrier casing from the magazine along the axis of the cartridge.

Referring now to the drawings and for the moment to FIG. 1, 10 designates an injection molded resilient plastic or solid casing tray structure for containing and/or transporting a plurality of open top box-like resilient plastic rectangular casing structures 11. Upstanding from the base 12 of the tray 10 are a plurality of vertical walls 13 spacing the casing structures 11 from each other side-by-side along the tray 10 with their open tops directed upwardly.

Positioned on each wall 13 are two spaced apart lugs or limit stops 14 positioned at a height along the walls 13 to engage the open tops of the casings 11 each of which contains a cartridge to permit the casings being slid transversely onto the tray 10 beneath the stops 14 which, will assure against the casings 11 being pulled upwardly between the walls 13. One longitudinal side 15 of the tray 10 along its major axis may have a barrier wall to guard against the casings 11 being pushed across and off the tray. Ledges 16 extend off the bottom of the walls 13 and form footing supports for the casings 11 when they are slid in place as shown in FIG. 1.

Figure 2:
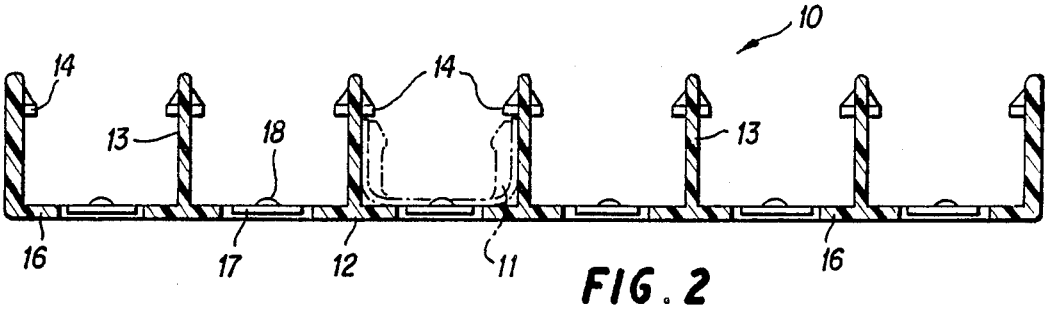
FIG. 2 is a vertical section view taken along the major axis of the magazine.
Figure 3:
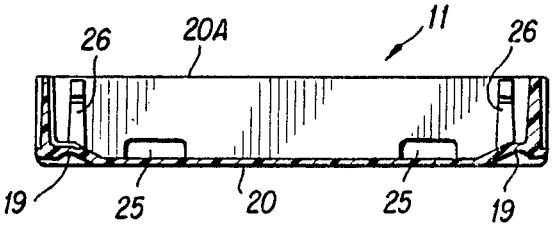
FIG. 3 is a vertical section view taken along the major axis of the casing.

At the bottom of the side of the tray 10 where the casings are introduced are positioned lip-like projections 17 each having a protuberance 18 positioned to register with dimpled recesses 19 in the bottom ends of the casings 11 as best seen in FIGS. 2 and 3 for locking the casings 11 in place between the walls 13 and assuring against an endwise shift of the casings 11 along their major axes relative to the tray 10 and to provide a snap fit of the casings 11 between the walls 13 and side ends of the tray 10.

The casings 11 have a bottom 20, an open top 20A, end walls 21, 22 joined by side walls 23, 24 and are provided with water drain and ventilation openings 25.

Figure 4:
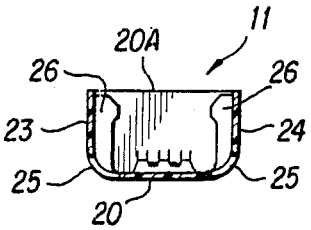
FIG. 4 is a vertical sectional view taken along the minor axis of the casing.
Figure 5:
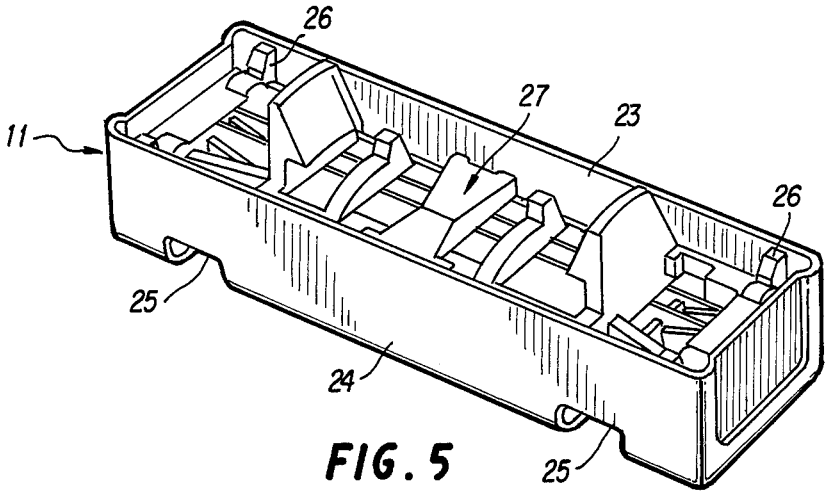
FIG. 5 is a fragmentary perspective view of a casing having a cartridge installed therein.
Figure 6:
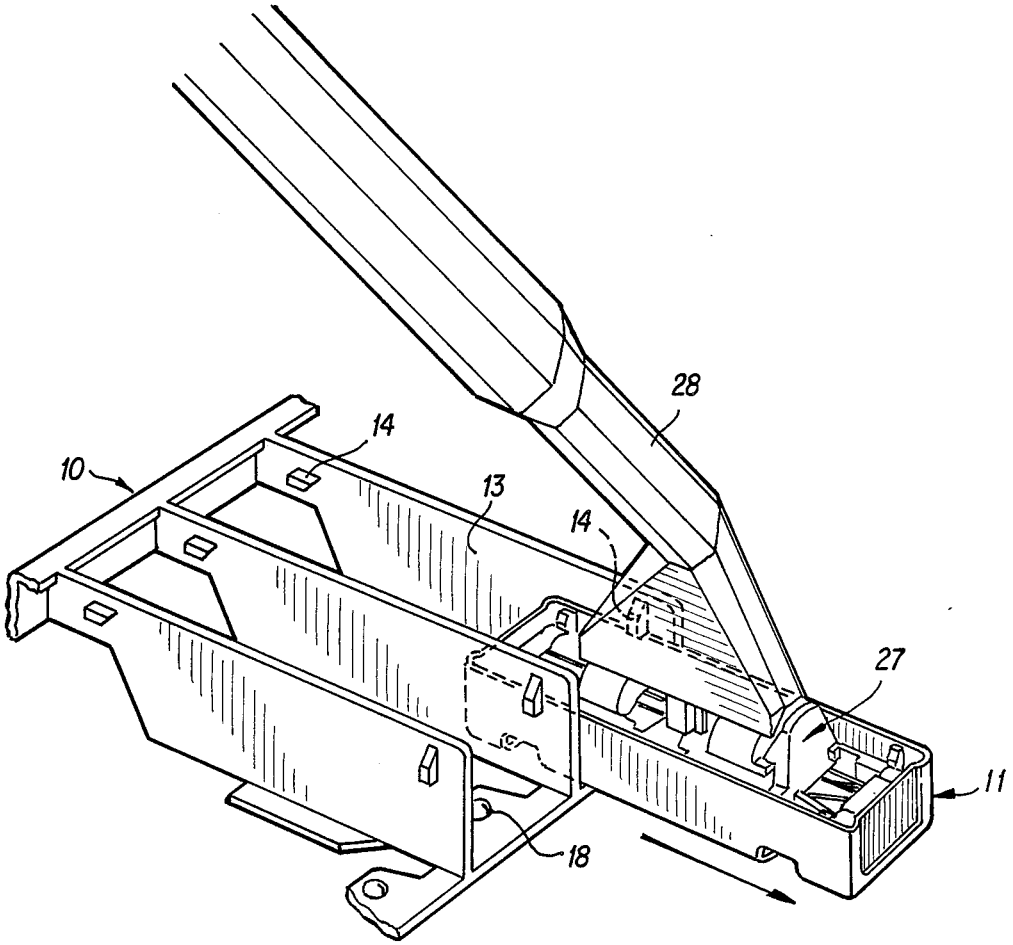
FIG. 6 is a fragmentary perspective view showing a casing and its contained cartridge being removed transversely of the major axis of the magazine tray by a razor handle.

As best seen in FIGS. 3, 4 and 5, each casing 11 within its open top box like structure has a set of vertical ribs 26 at each end which are spring biased to grip and yieldingly release a razor cartridge 27 when engaged by a handle 28 and rocked as shown by the arrows in FIG. 6 for removing the cartridge 27 from the casing 11 for shaving. The attachment of the handle 28 to the cartridge 27 is well known and described in the prior art patents referred to hereinbefore.

By having open top casings 11 and at least a one open sided tray structure the present invention as best seen in FIG. 1 permits the casing 11 to be retained on the tray 10 while the cartridge 27 is removed from the casing 11 open top by the razor handle 28 or once the handle is attached to the cartridge 27 while it is in place in the open top casing 11, the handle 28 may then be shifted toward the open side of the tray as shown in FIG. 6 which will overcome the lock between the protuberances 18 on the tray projection and the dimple recess 19 in the bottom of casing 11 permitting the casing 11, its cartridge 27 and handle 28 to be removed endwise from the tray as shown in FIG. 6. This will permit the razor cartridge 27 and handle 28 to be taken on an over night protected by the casing 11 until it is time to shave at which time by gripping the casing 11 in one hand and the handle 28 in the other and imparting a rocking action to the handle 28, the casing 11 may be removed for shaving and afterwards be replaced by reversing the sequence.

Figure 7:
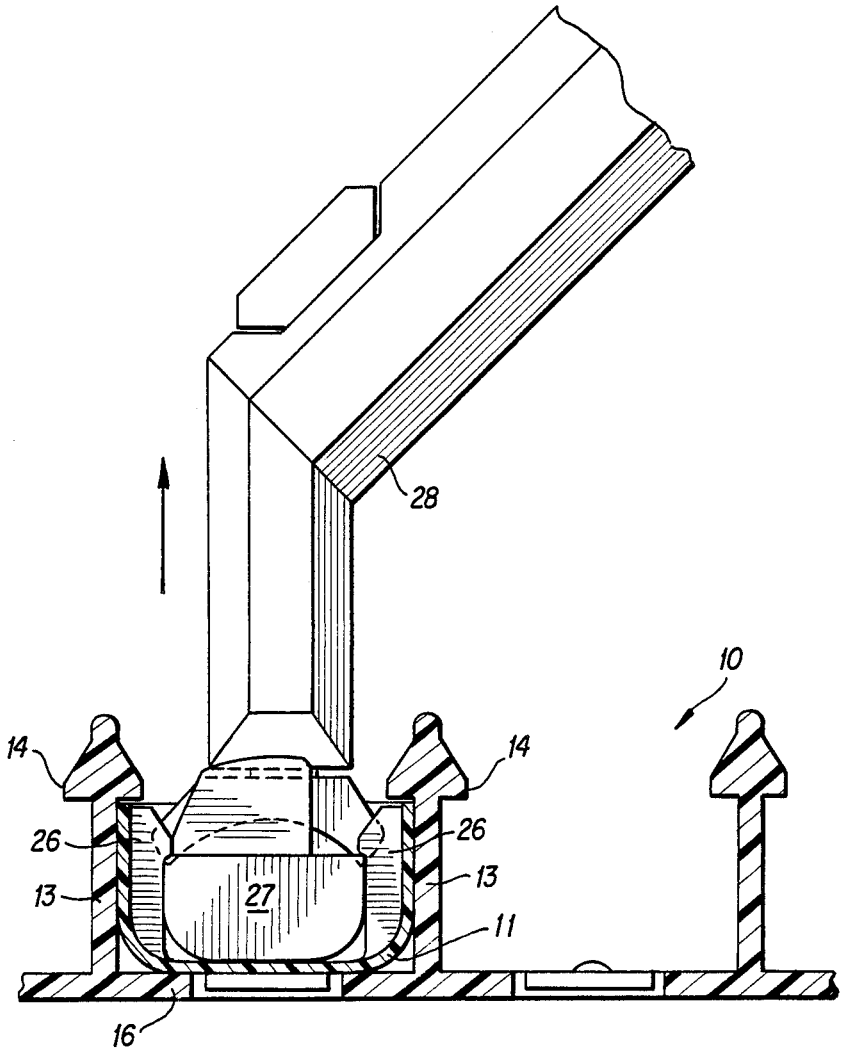
FIG. 7 is a vertical transverse sectional view of a cartridge casing containing a cartridge showing the cartridge being removed from the top of the casing in place on the casing tray by a removable razor handle.

As shown in FIG. 7 the cartridge 27 is engaged by the handle 28 and by rocking the handle the cartridge is disengaged from the grasp of ribs 26 and by raising the handle 28 the cartridge is removed from the casing 11 and tray or magazine 10.

What we claim is:

1. The combination of a plurality of razor shaving blade assembly units, retaining casings therefor and a flexible plastic storage tray for storing a plurality of said casings in side by side relationship thereon, each of said casings being adapted to retain a unitary shaving blade assembly unit, each shaving blade assembly unit comprising at least one blade and forming a head unit to which the blade is permanently secured and which provides a guard surface, said head unit being detachably engageable with a safety razor handle, each said casing defining a single chamber in which a single head unit may be retained, structure means in each said casing for retaining said head unit, therein against accidental removal in such a manner that a cutting edge of said blade is protected against damage and wherein said head unit is engageable by said handle while said head unit is still within said casing, each said head unit when engaged with said handle being withdrawable from the top of its casing by rocking said handle, said tray comprising slide means securing structure to secure each individual casing in said tray in side-by-side relationship, and said tray and slide means being so configured as to permit each of said casings to be slid endwise out of said tray transversely thereof by said handle engaged with said razor head unit such that with said handle engaged with said head an operator may remove said blade unit from said casing or may alternatively slidably remove said blade unit and casing from said tray.

2. Shaving cartridge retaining casings and a flexible plastic storage tray therefor as claimed in claim 1 wherein each casing is an open top box like resilient plastic casing structure having means within the casing to removably support a cartridge blade assembly in inverted position, plastic walls upstanding from said tray positioned to space a line of said open top plastic casings side-by-side from each other, projecting means extending from said tray walls positioned to engage the tops of said open top box like plastic casings to prohibit withdrawal of the casings upwardly from between said walls but to permit withdrawal of a cartridge from the open top of said casing and permitting the casing and cartridge to be slid transversely of the major axis of the tray for removal therefrom.

3. Shaving cartridge retaining casings and storage tray therefor as claimed in claim 2 wherein said means within the box like cartridge casing for retaining the cartridge in the casing are vertical alignment posts secured to the casing and resilient clip means at their free ends to restrain the cartridge within the casing to permit withdrawal of the cartridge by rocking it upwardly of the casing through its open top without disturbing the casing relative to the tray.

4. Shaving cartridge retaining casings and storage tray therefor as claimed in claim 1 wherein the open top box like casings have drain and ventilation openings between their side and bottom walls.

5. Shaving cartridge retaining casings and storage tray therefor as claimed in claim 1 wherein said slide means between said tray and the open top box like casings are dimpled recesses at the bottom of the ends of said casings along their major axis for resiliently registering with protrusions upstanding from the tray to cause a snap fit between the tray and casing to restrain the casing against sliding endwise of the tray unless subjected to a force sufficient to overcome the engagement of the protrusion upstanding from the tray with the dimpled recess at the underside ends of the open top casings.

* * * * *

UNITED STATES PATENT AND TRADEMARK OFFICE

CERTIFICATE OF CORRECTION

PATENT NO. : 4,742,909

DATED : May 10, 1988

INVENTOR(S) : Domenic V. Apprille, Jr. et al

It is certified that error appears in the above-identified patent and that said Letters Patent is hereby corrected as shown below:

On the title page Insert

--(73) Assignee: The Gillette Company, Boston, Mass. --.

Signed and Sealed this

Eighth Day of November, 1988

*Attest:*

DONALD J. QUIGG

*Attesting Officer*

*Commissioner of Patents and Trademarks*